United States Patent [19]

Johnson et al.

[11] 3,974,529

[45] Aug. 17, 1976

[54] BED AND LOUNGE UNIT

[75] Inventors: Clarence R. Johnson, St. Paul; Jay T. Kidder, Minneapolis; Orlando N. Talarico, Duluth, all of Minn.

[73] Assignee: The Tilt-A-Bed Corporation, Minneapolis, Minn.

[22] Filed: Oct. 3, 1975

[21] Appl. No.: 619,219

Related U.S. Application Data

[62] Division of Ser. No. 479,222, June 14, 1974, Pat. No. 3,925,834.

[52] U.S. Cl. ..... 5/18 R; 5/46; 5/13

[51] Int. Cl.[2] ..... A47C 17/14

[58] Field of Search ..... 5/10, 12, 13, 14, 16–18, 5/29–34, 46, 47, 133, 147

[56] References Cited

UNITED STATES PATENTS

| | | | |
|---|---|---|---|
| 2,568,366 | 9/1951 | Rosen | 5/18 R |
| 2,628,367 | 2/1953 | Green | 5/47 |
| 3,729,753 | 5/1973 | Johnson et al. | 5/12 R |

*Primary Examiner*—Casmir A. Nunberg
*Attorney, Agent, or Firm*—Burd, Braddock & Bartz

[57] ABSTRACT

A combination bed and lounge having a mattress assembly supported on wheels and track and guide structures for movement from a horizontal bed position to a seat position. The inner section of the mattress rides on downwardly and inwardly extended rails. The outer section of the mattress is carried by a movable support having a pair of wheels. The movable support cooperates with a locking member to releasably hold the mattress in the seat position. In one bed and lounge unit, a backrest is pivotally mounted to the inner section of the mattress and is movable to a backrest position when the mattress is in the seat position and an open position when the mattress is in the bed position. In another bed and lounge unit, a backrest is pivotally mounted on the cabinet accommodating the mattress assembly.

17 Claims, 13 Drawing Figures

BED AND LOUNGE UNIT

This application is a division of application Ser. No. 479,222, filed June 14, 1974, now U.S. Pat. No. 3,925,834.

BACKGROUND OF INVENTION

Folding beds and combination bed and lounge units have been used to minimize space and increase flexibility of a room. Folding beds are used in apartments, cabins, recreational vehicles, motels, hotels and like environments where floor space is restricted. Johnson and Kidder in U.S. Pat. No. 3,729,753 disclose a bed and lounge unit having a foldable mattress that moves relative to a storage chamber to a generally horizontal bed position and from the bed position to a seat position. A counterweight is used to assist in the movement of the mattress from the bed position to the seat position. The backrest for the seat position is pivotally mounted on a cabinet structure. Other combinations of bed and lounge units are shown in U.S. Pat. Nos. 2,568,366; 3,517,397; 3,600,034 and 3,803,643.

SUMMARY OF INVENTION

The invention relates to a combination bed and lounge unit having a foldable mattress that can be moved to a horizontal bed position and to a seat position. When the mattress is in the seat position, a portion of the mattress extends in an upward direction. The mattress is guided for movement on rail means and track means. A releasable holding means is used to maintain the mattress in the seat position. One feature of the invention is the use of a movable support for carrying the forward portion of the mattress. The movable support cooperates with a holding member to fix the seat position of the mattress. Another feature of the invention is the use of a movable backrest. The backrest is movably attached to the inner portion of the mattress and is moved to a backrest position and an open position.

An object of the invention is to provide a combination bed and lounge unit with cooperating rail and track structures which permit the unit to be used as a bed or lounge. A further object of the invention is to provide a combination bed and lounge unit which is constructed with a minimum of materials and parts and has a relatively low cost, yet is sturdy and durable. Yet another object of the invention is to provide a combination bed and lounge unit which does not utilize a counterweight and has a low overall height. A still further object of the invention is to provide a combination bed and lounge which has a rearwardly inclined pitch or seating angle when in the seating position. A still further object of the invention is to provide a combination bed and lounge unit which utilizes separate seating cushions when the unit is in the seating position. A further object of the invention is to provide a combined bed and seat unit with a foldable mattress assembly that is movable to a bed position having a conventional bed height. Another object of the invention is to provide a dual purpose bed and seat unit which can be readily and easily converted into either a bed or seat.

IN THE DRAWINGS

DESCRIPTION OF PREFERRED EMBODIMENTS

Figure 1:
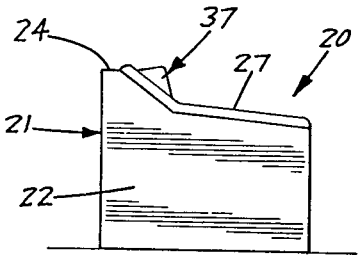
FIG. 1 is a side elevational view of the bed and lounge unit of the invention showing the unit in the lounge position.
Figure 2:
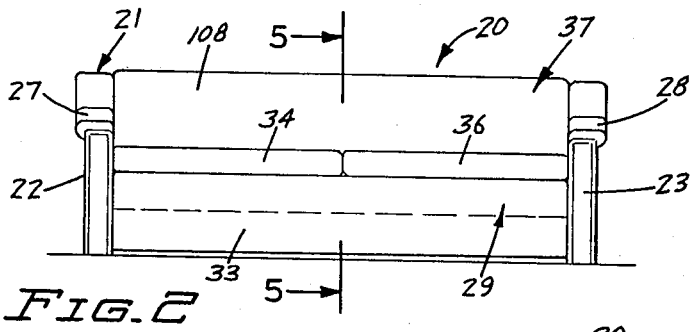
FIG. 2 is a front elevational view of FIG. 1.
Figure 3:
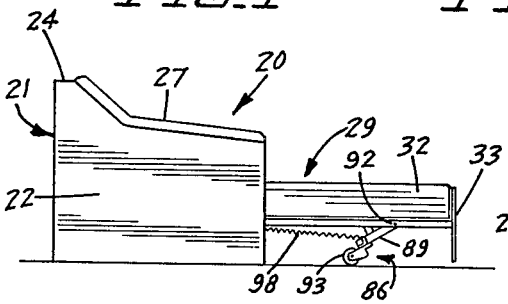
FIG. 3 is a side elevational view of the bed and lounge unit of the invention showing the unit in the bed position.
Figure 4:
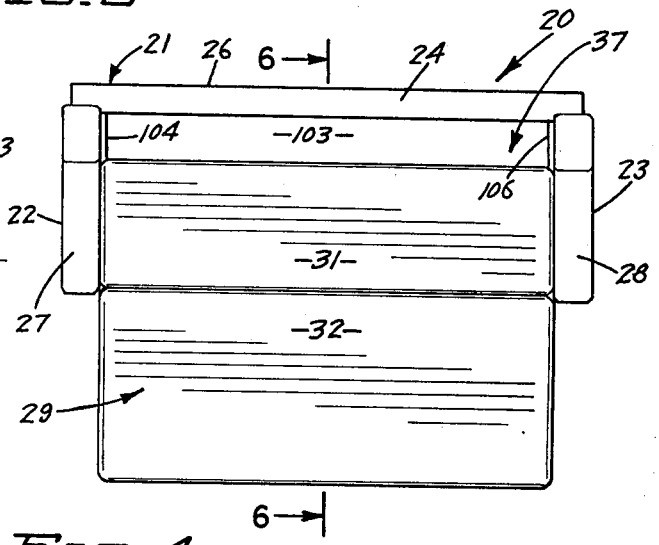
FIG. 4 is a top plan view of FIG. 3.

Referring to the drawings, there is shown in FIGS. 1–4 the bed and lounge unit of the invention indicated generally at 20. Unit 20 is a dual purpose furniture item useable as a lounge, sofa or seat, as shown in FIGS. 1 and 2. The unit can be converted from a lounge to a bed or sleeping unit by extending the mattress assembly to a horizontal or bed position as shown in FIGS. 3 and 4.

Bed and lounge unit 20 has a frame assembly or housing indicated generally at 21. Housing 21 has a pair of upright side panels or walls 22 and 23 attached to a generally horizontal transverse top 24. The back of housing 21 is enclosed with a panel 26. Arm rests 27 and 28 are mounted top of side walls 22 and 23. Arm rests 27 and 28 extend upwardly and rearwardly and provide the unit with arm style and contour. Other designs of side walls and arm rests can be used in bed and lounge unit 20. The detailed structure of arm rests 27 and 28 can be in accordance with the arm rests shown in FIGS. 13–15 of U.S. Pat. No. 3,729,753. Releasable structures, as shown in U.S. Pat. No. 3,729,753, can be used to removably mount arm rests 27 and 28 on side walls 22 and 23.

A mattress assembly indicated generally at 29 is movably supported on the frame 21 for selective movement to a generally horizontal bed position and a generally right angle seat position. When the mattress assembly 29 is in the seat position, one section 31 of the mattress assembly is folded to a generally upright position. The other section 32 of the mattress assembly is slightly inclined in the rearward direction to form the support for the seat cushions. The mattress assembly 29 has a first or inside section 31 and a second or outside section 32. The first section 31 is located in a generally upright position adjacent the back panel 26 when the mattress assembly is in the seat position. The mattress assembly 29 has a transverse front panel 33 which extends between the side walls 22 and 23, as shown in FIG. 2. The panel 33 provides a barrier or cover for the front of the mattress assembly and the space below the mattress assembly and the supporting floor.

As shown in FIG. 2, a pair of seat cushions 34 and 36 are located on top of the mattress assembly 29 when the mattress assembly is in the seat position. Located rearwardly of the seat cushions 34 and 36 is a generally upright backrest assembly indicated generally at 37. The seat cushions 34 and 36 in combination with backrest assembly 37 form the sofa or lounge of the unit 20. The backrest assembly 37 is movably connected to mattress assembly 29 and is movable to a position adjacent the back panel 26 when the mattress assembly is in the open or bed position, as shown in FIG. 4.

Figure 8:
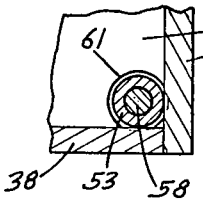
FIG. 8 is an enlarged sectional view taken along line 8—8 of FIG. 7.
Figure 7:
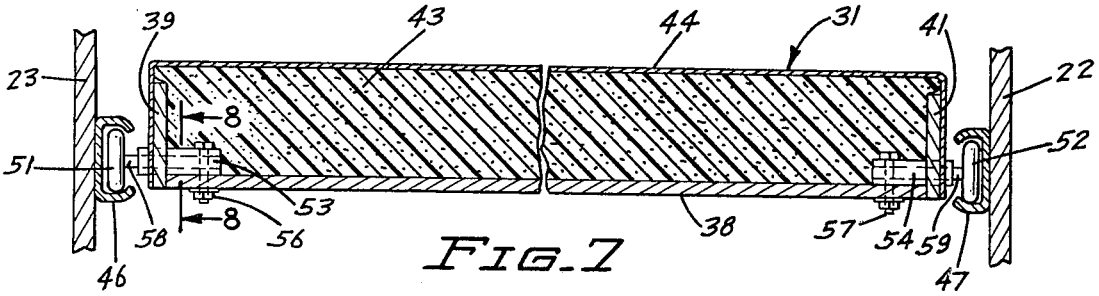
FIG. 7 is an enlarged sectional view taken along line 7—7 of FIG. 6.
Figure 5:
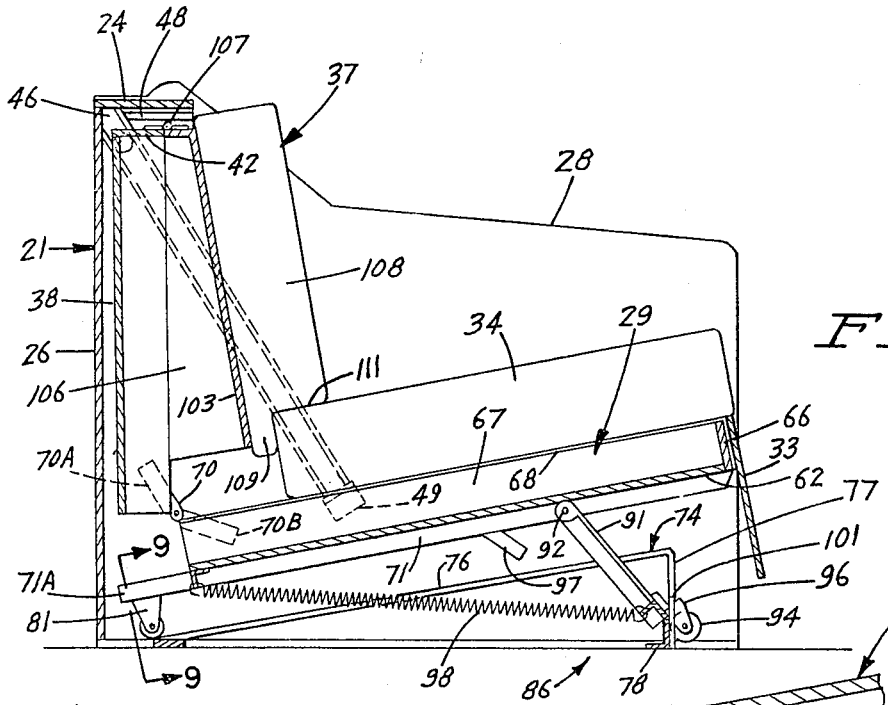
FIG. 5 is an enlarged sectional view taken along line 5—5 of FIG. 2.

Referring to FIG. 7, there is shown first section 31 of the mattress assembly. Section 31 has a generally flat, rigid base 38 of plywood or similar rigid material. Secured to the opposite sides of base 38 are upright side walls 39 and 41. As shown in FIG. 5, an end wall 42 is secured to the top end of base 38. Base 38, side walls 39 and 41 and end wall 42 form a cavity or space occupied by a resilient pad 43. Pad 43 may be of a compressible foamed material. Alternatively, pad 43 may be a plurality of coil springs, as shown in FIG. 8 of U.S. Pat. No. 3,729,753. The pad 43 is covered with a sheet member 44 such as a heavy fabric or the like. Member 44 is located over the top of pad 43 and is attached to the outside portions of the side walls 39 and 41 and end wall 42.

Section 31 is guided for generally upward movement by a pair of tracks 46 and 47. Tracks 46 and 47 have a generally U-shaped cross section and extend upwardly and in a rearward direction toward the top rear corner of the frame 21. As shown in FIG. 5, the top of track 47 is secured to an angle member 48. Angle member 48 is attached to frame 21 with suitable fastening means (not shown) as nut and bolt assemblies. The lower end of track 47 is secured to a stop 49. Stop 49 is attached to side frame 22 with bolts 50. Track 46 is attached to the frame of side wall 23 in a similar manner.

Tracks 46 and 47 have inwardly open channels accommodating rollers 51 and 52, respectively. Roller 51 is supported by a tube 53 mounted on base 38 with a nut and bolt assembly 56. As shown in FIG. 8, 8, tube 53 extends through a hole 61 in the side wall 38. The roller 51 is mounted on a shaft 58 rotatably mounted in tube 53. Roller 52 is carried by a tube 54 secured to base 38 with a nut and bolt assembly 57. A shaft 59 secured to roller 52 is rotatably mounted in tube 54. Tube 54 extends through a hole in side wall 41 similar to hole 61.

Figure 9:
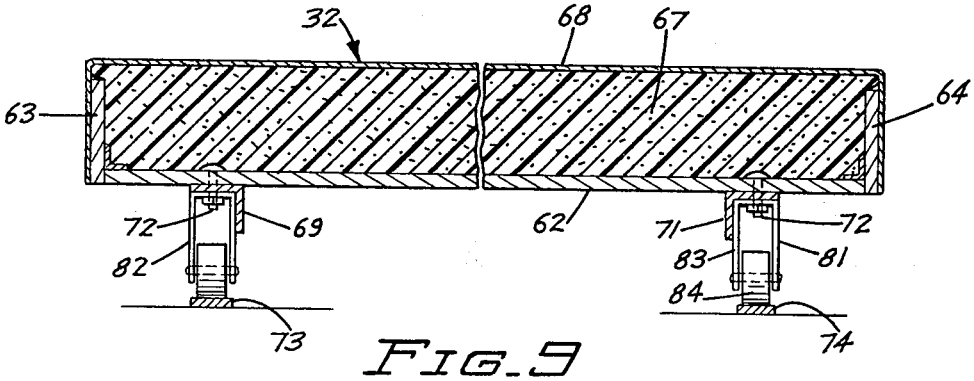
FIG. 9 is an enlarged sectional view taken along line 9—9 of FIG. 5.

Referring to FIG. 9, there is shown mattress section 32 having a generally flat, rigid base 62 of plywood or like material. Upright side walls 63 and 63 are secured to the opposite sides of base 62. As shown in FIG. 5, an upright end wall 66 is secured to the outer end of base 62. Base 62 forms with side walls 63 and 64 and end wall 66 a cavity or space accommodating a resilient pad 67. Resilient pad 67 can be a plurality of coil springs. The pad 67 is covered with a sheet member 68 of fabric, canvas or like material. Sheet member 68 extends over the outsides of side walls 63 and 64 and end wall 66 and is secured thereto.

Figure 6:
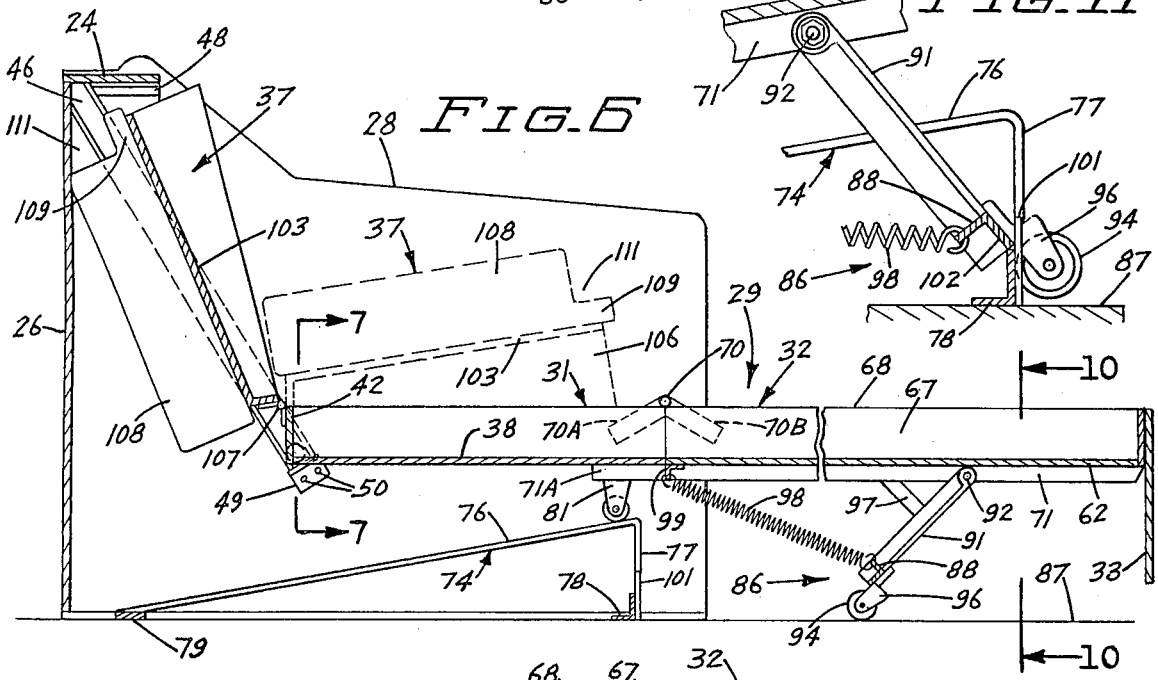
FIG. 6 is an enlarged sectional view taken along line 6—6 of FIG. 4.

Sections 31 and 32 are pivotally connected together with hinges 70. As shown in FIG. 6, hinge 70 has a first member 70A secured to side wall 39 and a second member 70B secured to side wall 64. Members 70A and 70B are pivotally connected with a transverse pin adjacent the top of walls 39 and 64 in the area where the walls 39 and 64 engage each other. The opposite walls 41 and 63 are connected with a hinge (not shown) identical with hinge 70. The transverse pivot axis of the hinges are transversely aligned so that the mattress assembly pivots about the transverse axes of the hinges.

Located below base 62 are a pair of elongated beams 69 and 71. Bolts 72 fasten beams 69 and 71 to the bottom of base 62. A pair of elongated rails 73 and 74 are located below and in alignment with beams 69 and 71. As shown in FIG. 5, rail 74 has a rearwardly and downwardly inclined guide or top surface 76 and a downwardly directed forward leg 77. The lower end of leg 77 is connected to a transverse bar or member 78 of the frame. The rear portion of rail 74 is attached to a transverse back member 79 of the frame. The rail 73 is attached to the bar 78 and member 79 in the same manner that rail 74 is attached to these structures.

As shown in FIG. 5, beam 71 has a rearwardly directed section 71A. Extended rearwardly from base 62. A supporting wheel assembly 81 is attached to beam section 71A. Wheel assembly 81 rides on the rail 74. Beam 69 has a similar rearwardly extended section 69A carrying a wheel assembly 82. Wheel assembly 82 rides on rail 73.

Each wheel assembly 81 and 82 has a generally inverted yoke assembly 83 secured to beams 69 and 71 with nut and bolt assemblies 72. Rotatably mounted on the yokes 83 is a roller or wheel 84.

Referring to FIGS. 5, 6, 10 and 11, there is shown the support and holding mechanism indicated generally at 86 for the outer section of the second section of the mattress assembly 29. Support and holding mechanism 86 functions to support section 32 on the floor or supporting surface 87 when the mattress assembly is in the bed or horizontal position shown in FIG. 6. The second function of the support and holding mechanism 86 is to hold the mattress assembly in the seat position, as shown in FIG. 5. The support and holding mechanism 86 also supports the seat in the seat position as shown in FIG. 5.

Support and holding mechanism 86 comprises a frame assembly including a cross bar 88 secured at its opposite ends to upwardly directed arms 89 and 91. Pivot pins 92 pivotally connect the upper ends of arms 89 and 91 to the respective means 69 and 71. Opposite end portions of the cross bar 88 support rollers 93 and 94. Holders 96 rotatably mount rollers 93 and 94. The rollers are secured to the cross bar 88 by suitable means, such as welds, bolts or the like. A pair of stop members 97 are secured to the beams 69 and 71 to limit the rearward movement of the frame assembly. As shown in FIGS. 5 and 6, stop members 97 extend in a forward and downward direction and engage arms 89 and 91. A tension spring 98 is secured to the midsection of cross bar 88 and a cross member 99. Cross member 99 is attached to base 62 of the mattress section 32. Spring 98 biases the frame assembly in the rearward direction to yieldably hold arms 89 and 91 in engagement with stop members 97. With the arms 89 and 91 in engagement with stop members 97, the mattress assembly is at a sleeping height, as shown in FIG. 6. The entire mattress assembly is supported by rollers 51 and 52 in engagement with stop members 49 at the lower end of tracks 46 and 47, the rollers 81 and 82 on the rails 73 and 74, and the rollers 93 and 94 engaging the supporting surface 87.

Figure 11:
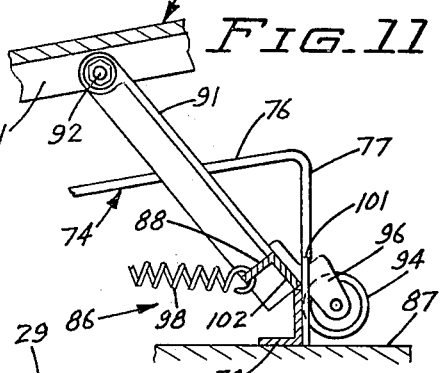
FIG. 11 is an enlarged sectional view of the releasable lock and holding structure for the mattress assembly shown in FIG. 5.
Figure 10:
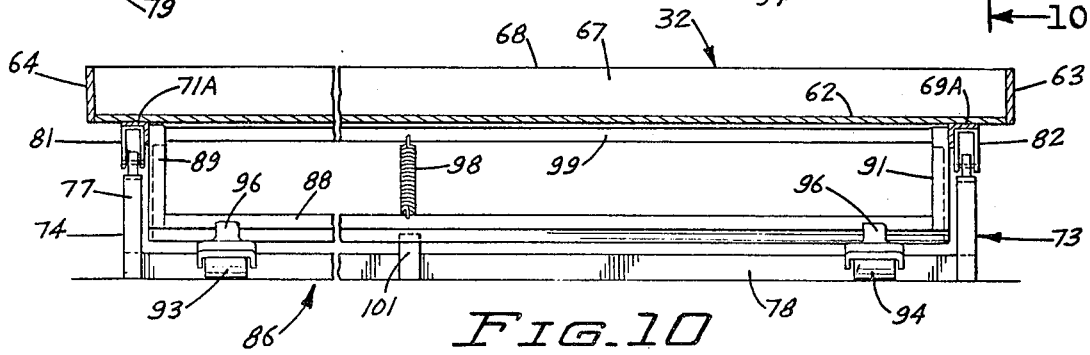
FIG. 10 is a sectional view taken along line 10—10 of FIG. 6.

Secured to the midsection of cross bar 78 is an upwardly directed tab or finger 101. As shown in FIG. 11, finger 101 extends upwardly from the top of cross member 78. When the mattress assembly 29 is in the seat position, the cross bar 88 is located behind the tab 101. A part 102 of cross bar 88 engages tab 101, preventing mattress assembly 29 from moving out to the horizontal position. Spring 98 biases the holders 96 into engagement with the top of cross member 78. Spring 98 prevents the cross bar 88 from moving over tab 101, thereby unlocking mattress assembly 29 from the seat position. When mattress assembly 29 is locked in the seat position, rollers 93 and 94 are arranged a slight distance off the supporting surface 87. To release the frame assembly from tab 101, the mattress assembly 29 is raised slightly and moved in an outward direction. This moves the rollers 93 and 94 into engagement with the supporting surface 87. The continued forward movement of mattress assembly 29 pivots the mattress assembly relative to the arms 89 and 91 to assist the movement of the mattress assembly in the forward direction. The wheel assemblies 81 and 82 ride on rails 73 and 74. The rollers 51 and 52 ride down tracks 46 and 47 until the mattress assembly is in a generally horizontal position, as shown in FIG. 6.

Referring to FIGS. 5 and 6, the backrest assembly 37 is pivotally mounted on the inner portion 31 of mattress assembly 29 with a plurality of hinges 107 whereby the backrest assembly moves to a generally upright position, as shown in FIG. 5, when the mattress assembly is in the seat position. The backrest assembly moves down to a generally horizontal position, shown in broken lines in FIG. 6, when mattress assembly 29 is moved to the bed position. The back rest assembly 37 is pivoted upwardly to place the cushion in the housing 21 between the tracks 46 and 47.

Backrest assembly 37 comprises a frame 103 having sides 104 and 106. Sides 104 and 106 have a general triangular configuration and extend toward the mattress section 31. Hinges 107 are secured to transverse portions of frame 103. Hinges 107 are also secured to end wall 42 of mattress section 31. As shown in FIGS. 2 and 5, a cushion 108 is secured to frame 103. Cushion 108 is of a length to extend between the arm rests 27 and 28. Returning to FIGS. 5 and 6, cushion 108 has a downwardly projected lower transverse lip 109 forming a transverse recess 111. As shown in FIG. 5, when the mattress assembly is in the seat position, cushions 34 and 36 extend into recess 111 and engage the lip 109. The cushion 108 thus aids in retaining cushions 34 and 36 in proper position on the mattress section 32 when the mattress section is in the seat position.

In use, with the bed and lounge unit in the seat position as shown in FIGS. 1 and 2, the support and holding mechanism retains the mattress assembly 29 in the seat position. The cushions 34 and 36 are held by backrest cushion 108 on mattress section 32. The bed and lounge unit 20 is converted from a seat to a bed by raising the front portion of section 32. This releases cross bar 88 from the tab 101. Spring 98 biases the cross bar 88 in a rearward direction, aiding outward movement of the mattress assembly. Section 31 of the mattress assembly is guided down tracks 46 and 47 with the rollers 51 and 52. The midsection of mattress assembly 29 is supported by the roller assemblies 79 and 81. These roller assemblies ride up the tracks 73 and 74 until mattress assembly 29 is in the full open position. Arms 89 and 91 engage the stop members 97 and thereby support outer section 32 of the mattress assembly 29.

To convert the unit 20 from a bed to a lounge, an inwardly directed force is applied to the mattress assembly 29. The section 31 moves upwardly along the tracks 46 and 47. Roller assemblies 79 and 81 move down rails 73 and 74. Rollers 93 and 94 ride on supporting surface 87. Mattress assembly 29 folds about the pivot axes of the hinges 70 whereby section 31 moves in an upward direction into housing 21. Rollers 93 and 94 will engage the cross member 78 which serves as a stop for the rollers. Continued movement of the mattress in an inward direction pivots arms 89 and 91 away from stop members 97 and against the biasing force of spring 98. Cross bar 88 will move over tab 101. Continued movement of the mattress assembly 29 in an inward direction will force the cross bar 88 behind the tab 101, thereby locking the mattress assembly 29 in the seat position, as shown in FIGS. 5 and 11.

Figure 12:
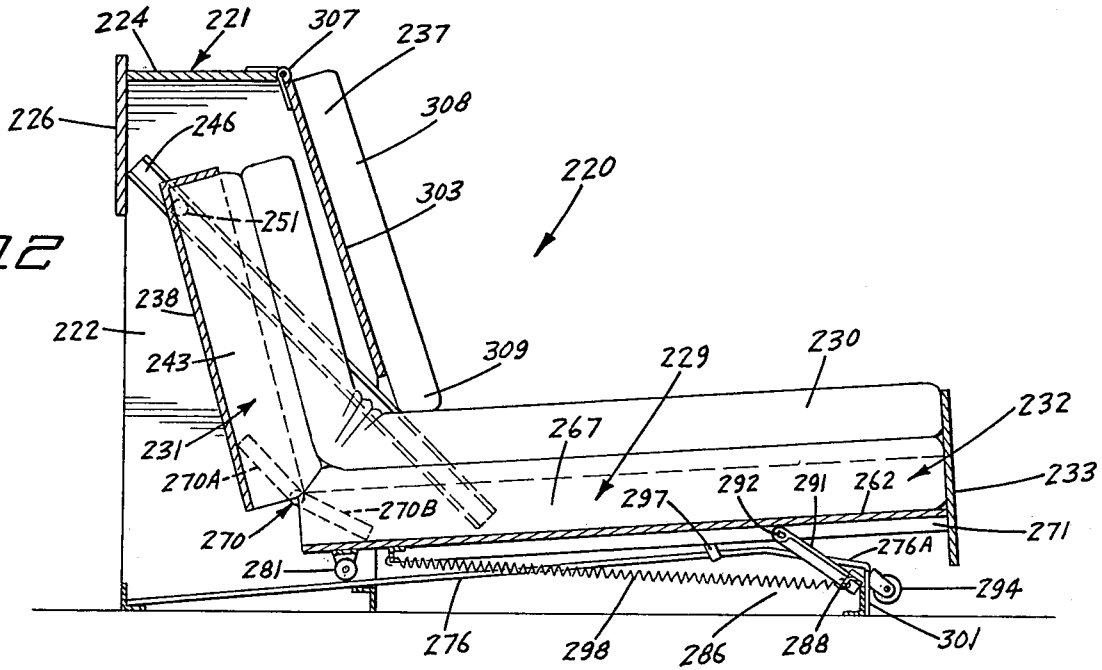
FIG. 12 is a sectional view of a modification of the bed and lounge unit of the invention in the lounge position.
Figure 13:
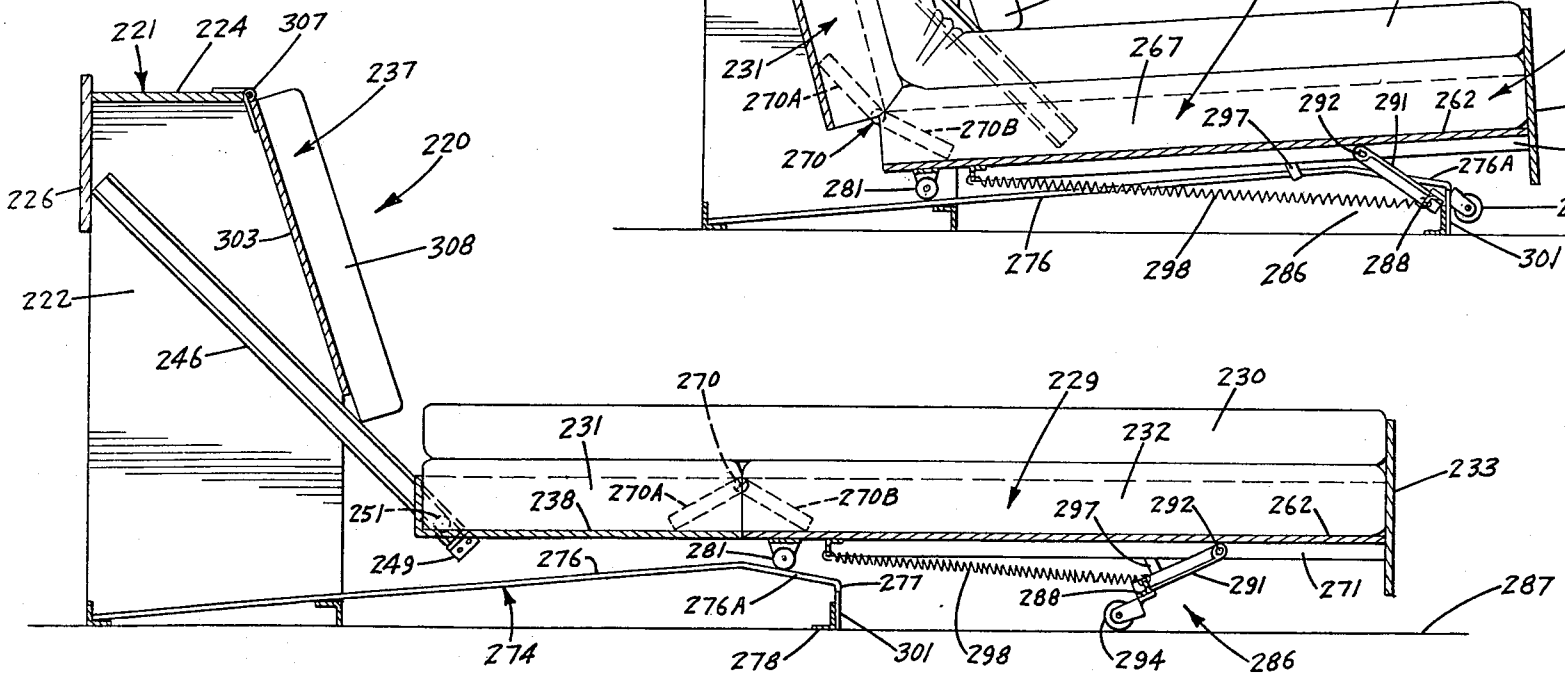
FIG. 13 is a sectional view of the bed and lounge unit of FIG. 12 showing the unit in the bed position.

Referring to FIGS. 12 and 13, there is shown a modification of the bed and lounge unit of the invention indicated generally at 220. Unit 220 has a frame or housing 221 having spaced upright side walls 222 and top wall 224. The back of the housing has a back panel 226.

Bed and lounge unit 220 has a foldable mattress assembly indicated generally at 229. The mattress assembly 229 has a first section 231 adapted to move up into housing 221 and a second section 232 adapted to be located in a seat position, as shown in FIG. 12. When the unit 220 is in the bed position, as shown in FIG. 13, the mattress sections 231 and 232 are located in a side-by-side generally horizontal position. A cushion or mattress unit 230 is located on the mattress assembly. A front panel 233 is connected to the front portion of mattress section 232.

A back rest assembly indicated generally at 237 is movably mounted on housing 221. Back rest assembly 237 comprises a support or frame 303. A plurality of hinges 307 pivotally mount the upper end of support 303 to the top wall 224, permitting the back rest assembly to be moved in an upward direction away from mattress assembly 227. A resilient cushion 308 is secured to the front of frame 303. The cushion has a lower portion 309. As shown in FIG. 12, portion 309 is located in close proximity to the top of seat cushion 230 when the unit is in the lounge position.

Mattress section 231 has a generally box-shaped member 238 carrying a mattress 243. Mattress 243 can be a resilient foam material or a plurality of coiled springs. The mattress section 232 has a generally box-shaped frame carrying mattress 267. Mattresses 243 and 267 can be the same as mattresses 43 and 67 shown in FIGS. 7 and 9. Mattress sections 231 and 232 are pivotally connected with side hinges 270. Each hinge has a first part 270A secured to support 238 and a second part 270B secured to support 262 so that sections 231 and 232 can pivot relative to each other about a transverse axis.

Secured to the bottom of support 262 are a pair of beams 271. The beams carry the support and holding mechanism for section 232. The rear part of section 232 is supported on a pair of inclined rails 274. The rails have a top surface 276 and an upright surface 277. Surface 276 has a slightly downwardly and forwardly inclined section 278A adjacent section 277. Wheels 281 ride on surfaces 276 and 276A of rails 274.

The support and holding mechanism 286 comprises a frame including a cross bar 288 and upwardly directed arm 291. Pivots 292 pivotally connect the arms to beams 271. A pair of rollers 294 are secured to cross bar 288. A spring 298 biases the support into engagement with stops 297 secured to beams 271. The support and holding mechanism is identical in construction to support and holding mechanism 86.

Cross bar 288 cooperates with an upwardly directed tab or member 301 secured to the midsection of cross member 288, as shown in FIG. 12, to lock the mattress assembly in the seat position.

Referring to FIG. 13, when mattress assembly 229 is in the bed position, section 231 is supported on tracks 246 with rollers 251. The midsection of the mattress assembly is supported on rails 274 with rollers 281. Rollers 281 are located on the downwardly and forwardly inclined surface 276A, thereby holding the mattress assembly 229 in the open position. The arms 291 engage the stops 297 and thereby support the outer end of section 232 on the supporting surface 287.

There have been shown and described preferred embodiments of the invention. It is understood that changes, modifications and substitutions of matrials, sizes and parts may be made without departing from the invention.

The embodiments of the invention in which an exclusive property or privilege are claimed are defined as follows:

1. A combination bed and lounge unit comprising: a frame, a seat and bed unit having an inner section and an outer section, track means extending rearwardly upward mounted on the frame for guiding the seat and bed unit for selected movement between a bed position and a seat position, means on the inner section engageable with the track means, rail means inclined rearwardly downward secured to the frame located below the seat and bed unit for supporting a part of the seat and bed unit, means mounted on the seat and bed unit engageable with the rail means for movement upwardly on the rail means when the means on the inner section of the seat and bed unit moves downwardly on the track means whereby when a part of the seat and bed unit moves relative to the rail means, a part of the seat and bed unit moves on the track means to facilitate movement of the unit between the seat and bed positions, means for releasably locking the seat and bed unit in the seat position, and means pivotally connected to the outer section permitting movement of the outer section to proper orientation and supporting the outer section in the bed position, said means pivotally connected to the outer section including wheel means for supporting the outer section, support means for carrying the wheel means, means pivotally mounting the support means to the seat and bed unit, stop means on the seat and bed unit to limit movement of the support means relative to the unit, means biasing the support means into engagement with the stop means, said means for releasably locking the seat and bed unit in the seat position comprising a first means on the frame, and second means on the support means cooperating with the first means to hold the support means in a fixed position.

2. The structure of claim 1 wherein: the seat and bed unit comprise a first section, a second section, and pivot means movably connecting the first section to the second section, said first section and second section having generally upright side and end walls forming an open top box, and resilient means located in said box.

3. The structure of claim 2 wherein: the second section is larger than the first section.

4. The structure of claim 2 including: roller means connected to the first section and engageable with the track means to guide said first section during movement of the seat and bed unit between the seat position and the bed position.

5. The structure of claim 1 wherein: the rail means are a plurality of members elongated in the direction of movement of the seat and bed unit, each of said members sloping in a downward and inward direction.

6. The structure of claim 1 wherein: the seat and bed unit includes a foldable mattress assembly, a back rest, and means movably mounting the back rest on the mattress assembly whereby the back rest is movable to a first position adjacent the mattress assembly to provide a seat back when the mattress assembly is in the bed position.

7. The structure of claim 1 wherein: the seat and bed unit includes a foldable mattress assembly, said mattress assembly having a base and beam means secured to the base, means pivotally mounting the support means on the beam means, said stop means being located on the beam means to limit the position of the support means, and said biasing means being operable to yieldably hold the support means in engagement with the stop means.

8. A combination bed and lounge unit comprising: a frame, a seat and bed unit having an inner section and an outer section and a foldable mattess assembly, said mattress assembly having a base and beam means secured to the base, track means extended rearwardly upward mounted on the frame for guiding the seat and bed unit for selective movement between a bed position and a seat position, means on the inner section engageable with the track means, rail means inclined rearwardly downward secured to the frame located below the seat and bed unit for supporting a part of the seat and bed unit, means mounted on the seat and bed unit engageable with the rail means for movement upwardly on the rail means when the means on the inner section of the seat and bed unit moves downwardly on the track means whereby when a part of the seat and bed unit moves relative to the rail means a part of the seat and bed unit moves on the track to facilitate movement of the unit between the seat and bed positions, means for releasably locking the seat and bed unit in the seat position, and means pivotally connected to the outer section permitting movement of the outer section to proper orientation and supporting the outer section in the bed position, said means pivotally connected to the outer section including a support means, means pivotally mounting the support means on the beam means, stop means on the beam means to limit the position of the support means relative to the beam means, biasing means to yieldably hold the support means in engagement with the stop means, said frame including a member located below the mattress assembly, said means for releasably locking the seat and bed unit in the seat position comprising a first means on the member of the frame and a second means on the support means cooperating with the first means to hold the support means in a fixed position and thereby hold the seat and bed unit in the seat position.

9. The structure of claim 8 wherein: the seat and bed unit comprise a first section, a second section, and pivot means movably connecting the first section to the second section, said first section and second section having generally upright side and end walls forming an open top box, and resilient means located in said box.

10. The structure of claim 9 wherein: the second section is larger than the first section.

11. The structure of claim 9 including: roller means connected to the first section and engageable with the track means to guide said first section during movement of the seat and bed unit between the seat position and the bed position.

12. The structure of claim 8 wherein: the rail means are a plurality of members elongated in the direction of movement of the seat and bed unit, each of said members sloping in a downward and inward direction.

13. The structure of claim 8 including: wheel means attached to the support means for rotatably supporting the support means on a surface.

14. In a combination bed and lounge unit having a mattress assembly selectively movable to a bed position and a seat position: back rest means forming a generally upright seat back, means movably connecting the back rest means to the mattress assembly, said back rest means movable to a first position adjacent the mattress assembly to provide a seat back when the mattress assembly is in the seat position and movable to a second position away from the mattress assembly is in the bed position.

15. The structure of claim 14 wherein: the means movably connecting the back rest to the mattress assembly includes means to pivotally mount the back rest means to the mattress assembly.

16. The structure of claim 14 wherein: said mattress assembly has a first section, a second section and means pivotally connecting the first section to the second section, track means for guiding the first section of the mattress assembly in an upright direction when the mattress assembly is in the seat position, said means movably connecting the back rest means being connected to the first section of the mattress assembly.

17. The structure of claim 14 wherein: said mattress assembly has a transverse top portion when in the seat position, said back rest mean having a transverse top member, said means movably connecting the back rest means to the mattress assembly comprising pivot means pivotally connecting the top section of the mattress assembly to the top member of the back rest means.

* * * * *

UNITED STATES PATENT AND TRADEMARK OFFICE

CERTIFICATE OF CORRECTION

PATENT NO. : 3,974,529

DATED : August 17, 1976

INVENTOR(S) : Clarence R. Johnson et al

It is certified that error appears in the above-identified patent and that said Letters Patent are hereby corrected as shown below:

Column 2, line 41, after "mounted", --on-- is omitted.

Column 8, Claim 8, line 3, "mattess" should be --mattress--.

Column 10, Claim 17, line 3, "mean" should be --means--.

Signed and Sealed this

Twenty-third Day of November 1976

[SEAL]

*Attest:*

RUTH C. MASON
*Attesting Officer*

C. MARSHALL DANN
*Commissioner of Patents and Trademarks*